US006967618B2

(12) United States Patent
Ojantakanen et al.

(10) Patent No.: US 6,967,618 B2
(45) Date of Patent: Nov. 22, 2005

(54) ANTENNA WITH VARIABLE DIRECTIONAL PATTERN

(75) Inventors: Seppo Ojantakanen, Suzhou (FI); Timo Leppäluoto, Oulu (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 10/408,048

(22) Filed: Apr. 4, 2003

(65) Prior Publication Data

US 2003/0189523 A1 Oct. 9, 2003

(30) Foreign Application Priority Data

Apr. 9, 2002 (FI) ..... 20020674

(51) Int. Cl.[7] ..... H01Q 1/38
(52) U.S. Cl. ..... 343/700 MS; 343/702
(58) Field of Search ..... 343/702, 700 MS, 343/895

(56) References Cited

U.S. PATENT DOCUMENTS

| | | | | |
|---|---|---|---|---|
| 6,031,496 | A * | 2/2000 | Kuittinen et al. | 343/702 |
| 6,034,638 | A | 3/2000 | Thiel et al. | 343/702 |
| 6,069,592 | A * | 5/2000 | Wass | 343/895 |
| 6,229,488 | B1 * | 5/2001 | Lin et al. | 343/700 MS |
| 6,351,241 | B1 * | 2/2002 | Wass | 343/702 |
| 6,570,538 | B2 * | 5/2003 | Vaisanen et al. | 343/702 |
| 6,606,071 | B2 * | 8/2003 | Cheng et al. | 343/767 |
| 2001/0040528 | A1 * | 11/2001 | Vaisanen et al. | 343/700 MS |
| 2002/0019247 | A1 | 2/2002 | Egorov | |
| 2003/0146878 | A1 * | 8/2003 | Mikkola et al. | 343/702 |

FOREIGN PATENT DOCUMENTS

| | | | |
|---|---|---|---|
| EP | 0 367 609 A2 | 5/1990 | |
| EP | 0635898 | 1/1995 | H01Q 1/27 |
| EP | 1152481 | 11/2001 | H01Q 1/24 |
| EP | 1172884 | 1/2002 | H01Q 1/24 |
| EP | 1 271 688 A1 | 1/2003 | |
| FI | 75949 | 4/1988 | H01Q 1/27 |
| WO | WO 97/44911 A1 | 11/1997 | |

OTHER PUBLICATIONS

Patent Abstract of Japan, vol. 2000, No. 5, Sep. 14, 2000, JP 2000 040910, Feb. 2000.
Rodney Vaughan, "Switched Parasitic Elements for Antenna Diversity", IEEE Transactions on Antennas and Propagation, vol. 47, No. 2, Feb. 1999, pp. 399-405.
Y. Takumi, "Antenna", publication number 2000138518, May 2000, Patent Abstract.

* cited by examiner

*Primary Examiner*—Wilson Lee
*Assistant Examiner*—Huedung X. Cao
(74) *Attorney, Agent, or Firm*—Darby & Darby

(57) ABSTRACT

An antenna of a radio apparatus, the directional pattern of which can be altered controllably. The antenna comprises at least one conductive element, additional from the viewpoint of the basic operation of the antenna, for shaping the directional pattern of the antenna. Such a conductive element (330, 340) is connected to signal ground at a ground point relatively near the feed point (F) of the antenna. The conductive element has a part (331) the length of which is about a quarter of the wavelength at an operating frequency of the antenna, pointing from the ground point (G) in a direction substantially opposite to the feeding direction of the radiating element (320). That part is used to equalize the directional pattern of the antenna in the receiving band. In addition, the conductive element has a second part (332) pointing from the ground point to the feeding direction of the radiating element to set a directional pattern notch at transmitting band frequencies in a desired direction.

10 Claims, 4 Drawing Sheets

ANTENNA WITH VARIABLE DIRECTIONAL PATTERN

BACKGROUND OF THE INVENTION

The invention relates to an antenna which is intended especially for radio telephones and the directional pattern of which can be altered controllably. The invention further relates to a radio telephone having such an antenna.

It is usually advantageous for the operation of a two-way radio apparatus if the transmitting and receiving characteristics of its antenna are good in all directions. In practice, antenna efficiency in transmitting and receiving varies depending on the direction, often drastically. In mobile communications networks, multipath propagation reduces the disadvantage caused by the unevenness of the antenna directivity pattern, but naturally it is preferred that the directivity pattern is as even as possible. As regards transmitting characteristics in communications devices held against the user's ear, it is considered undesirable that radiation is directed towards the user's head. Therefore, an ideal mobile telephone antenna receives well from all directions but transmits weakly into the sector where the user's head is located when the phone is placed in its normal operating position.

As regards receiving, the above-mentioned desirable characteristics are achieved with a whip antenna having a large ground plane, for its directivity pattern is circular on the plane perpendicular to the axis of the whip. In practice, the ground plane is the body of the radio apparatus, which is relatively small and indefinitely shaped from the antenna standpoint. Therefore, the directivity pattern may have considerable alternation. Likewise, as regards transmitting, the shape of the directivity pattern of a conventional whip antenna of a mobile phone varies uncontrollably so that radiation is directed towards the user's head, too.

Structures are known from the prior art where the antenna field is attenuated in the direction of the user's head by means of an additional element. FIGS. 1*a,b* show an example of such a structure. FIG. 1*a* shows a portion of the body 110 of a mobile phone and, above that, a small antenna circuit board 120 on the front side of which there is a meander-type radiating element 121. This is connected by its bottom end to the antenna port through a feed conductor 125. On the back side of the circuit board 120, shown in FIG. 1*b*, there is a conductive patch 122 which covers a major part of the radiating element. When the phone is in the use position, the conductive patch 122 stands between the radiating element and the user's head. The conductive patch is connected to signal ground GND so that it does not function as a significant parasitic radiator. Instead, it functions as a surface reflecting radio waves, attenuating radiation in the direction of the user's head. A drawback of this solution is that also the reception characteristic of the antenna deteriorates in said direction.

SUMMARY OF THE INVENTION

An object of the invention is to reduce the above-described disadvantages associated with the prior art. An antenna according to the invention is characterized in that which is specified in the independent claim 1. A radio telephone according to the invention is characterized in that which is specified in the independent claim 10. Preferred embodiments of the invention are presented in the dependent claims.

The basic idea of the invention is as follows: At least one conductive element, additional from the viewpoint of the basic operation of the antenna, is added to the antenna structure of a radio telephone in order to change the directivity pattern of the antenna. Such a conductive element is connected to signal ground at a point relatively near the feed point of the antenna. The conductive element includes a part the length of which is about a quarter-wave length at the operating frequency of the antenna and which is directed from the ground point to a direction opposite to the feeding direction of the radiating element. This part is used to equalize the directivity pattern of the antenna in the receiving band. In addition, the conductive element includes a second part which is substantially shorter and directed from the ground point to the feeding direction of the radiating element. The second part is used to set a notch in the directivity pattern at transmitting band frequencies so that it is in a desired direction.

An advantage of the invention is that the directivity pattern of an antenna can be shaped separately in the transmitting and receiving bands of a given radio system. This means that the directivity pattern can be kept relatively even in the receiving band despite the fact that a directivity pattern notch is provided in the transmitting band. Another advantage of the invention is that when using an external antenna, said notch can be achieved through an internal arrangement in the radio telephone without additional elements in the external antenna. A further advantage of the invention is that the arrangement according to the invention is simple.

BRIEF DESCRIPTION OF THE DRAWINGS

The invention will now be described in detail. The description refers to the accompanying drawing wherein.

DETAILED DESCRIPTION OF THE INVENTION

Figure 1:
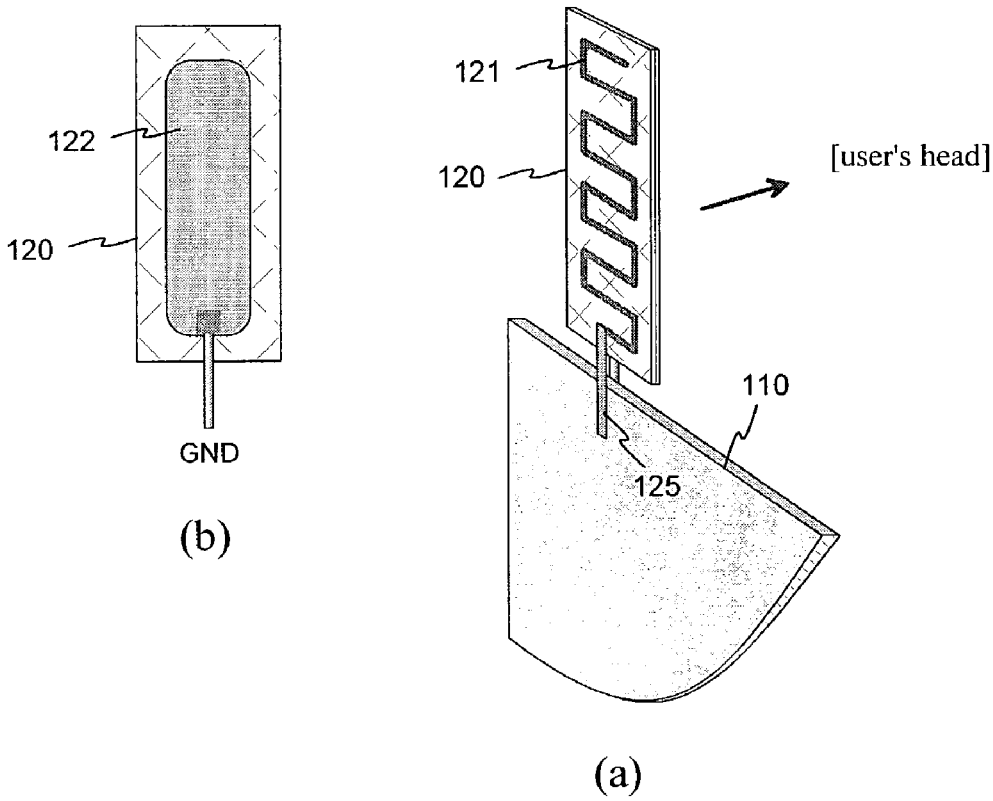
Fig. 1 PRIOR ART
FIG. 1 is an example illustrating a prior-art method of changing the directivity pattern of an antenna.
Figure 2:
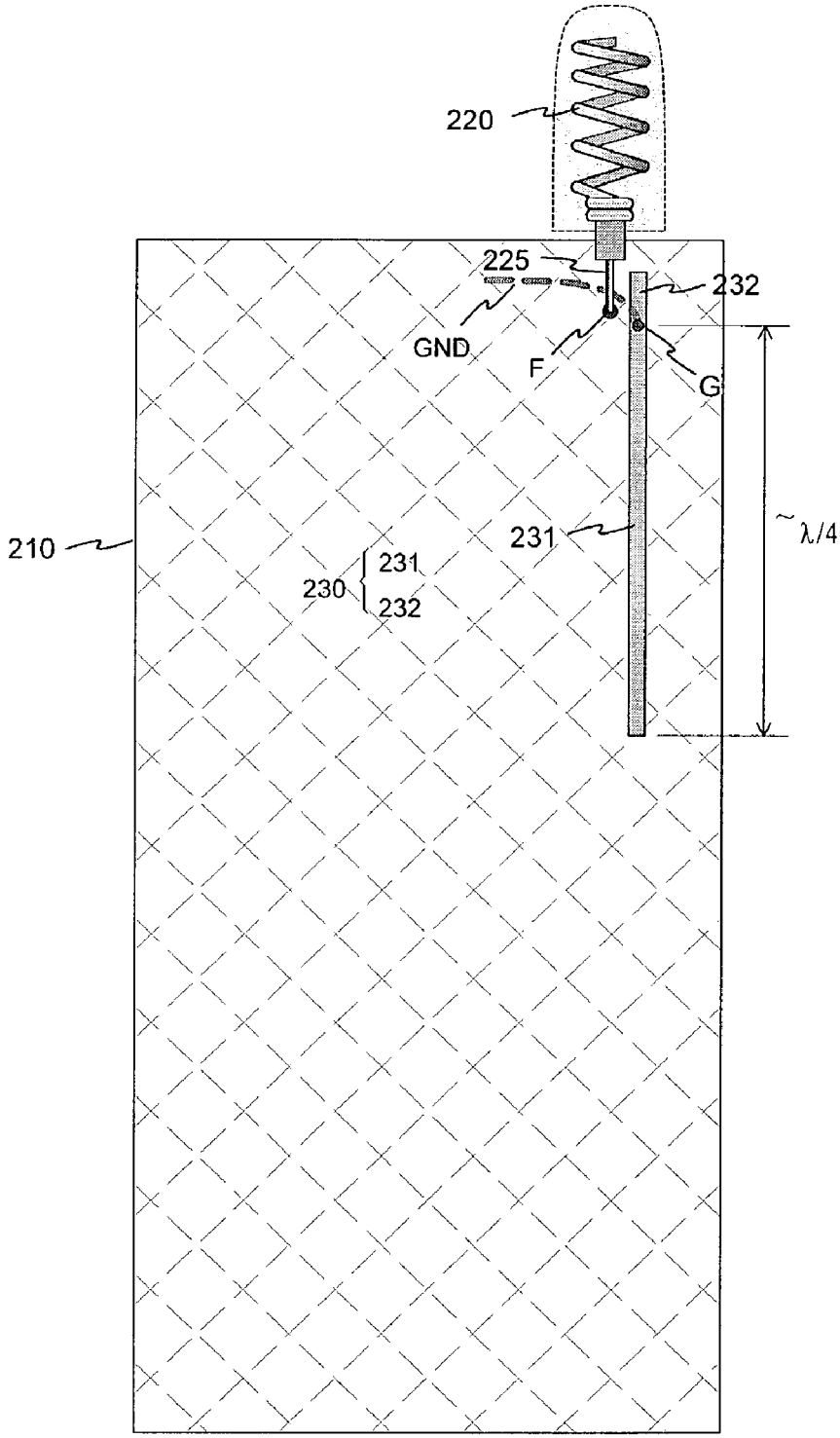
FIG. 2 is an example illustrating how the directivity pattern of an antenna can be changed in accordance with the invention.

FIG. 2 shows enlarged an example of an antenna structure according to the invention. The radiating element proper is a helix conductor 220 outside the covers of a radio telephone, placed within a protective sheath. The helix may be dimensioned so as to function in frequency bands of two radio systems. A feed conductor 225, an extension to the helix conductor, is galvanically connected to a circuit board 210 in the radio telephone at a feed point F of the antenna. The feed point F is connected via a duplex filter or antenna switch to the transmitter and receiver of the radio telephone. In addition, the antenna structure comprises a conductive strip 230 according to the invention on the surface of the circuit board 210. The conductive strip 230 is connected to signal ground GND relatively close to the feed point F. A thick broken line represents the signal ground. It may be located on the back surface of the circuit board and, in the case of a multilayer board, in intermediate layers as well. "Relatively close" means here that the distance between the ground point G of the conductive strip and the feed point F of the antenna is smaller than a tenth of the wavelength corresponding to the operating frequency. The ground point G divides the conductive strip into a first part 231 and a second part 232. The length of the first part substantially equals a quarter of the wavelength, and the first part is directed from the ground point to a direction opposite to the feeding direction of the radiating element. The second part 232 of the conductive element 230 is substantially shorter than the first part, and it is directed from the ground point G to the feeding direction of the radiating element.

The first part 231 of the conductive element according to the invention is used to equalize the antenna directivity pattern in the receiving band. This is based on the fact that the antenna structure becomes more regular, dipole-like, removing distinct notches caused in the directivity pattern by the radio telephone body and other conductors functioning as signal ground. Since the shape and location of signal ground e.g. in a circuit board of the radio telephone are indefinable from the antenna standpoint, the exact optimum length of the first part 231 of the conductive element must be found experimentally. The second part 232 of the conductive element is used to move a notch of the directivity pattern affecting in the transmitting band to the desired direction. This is based on the fact that a conductor beside the feed point and feed conductor affects the directivity pattern more strongly than one farther away: Even a small change in the second part 232 will have a significant effect on the locations of the lobes and notches of the directivity pattern.

Figure 3:
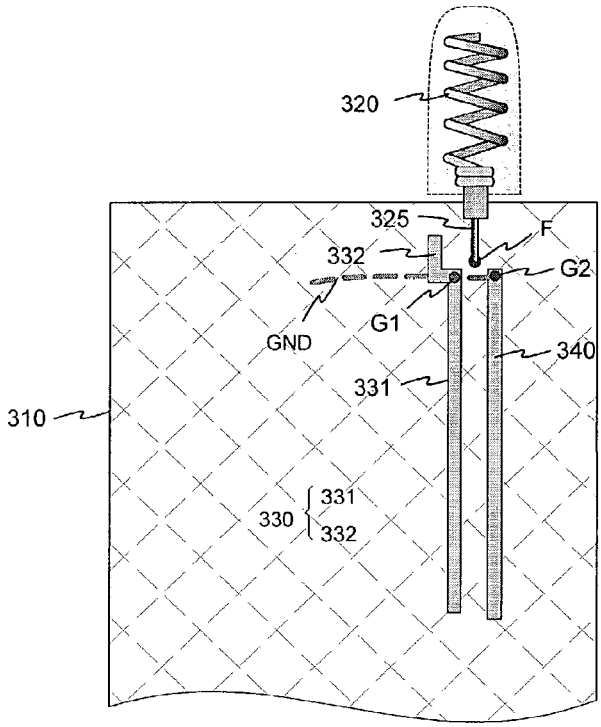
FIG. 3 is a second example illustrating how the directivity pattern of an antenna can be changed in accordance with the invention.

FIG. 3 shows a second example of an antenna structure according to the invention. In this case, too, the radiating element proper 320 is a helix conductor. A feed conductor 325, which is an extension to the helix conductor, is galvanically connected to the radio telephone circuit board 310 at an antenna feed point F, as in FIG. 2. The difference is that now the antenna structure comprises not one but two conductive strips according to the invention. The first conductive strip 330 is nearly identical with strip 230 in FIG. 2. It has a first ground point G1, from which there extend in different directions a first part 331, the length of which is substantially a quarter of the wavelength, and a second part 332, which is short compared to the first part. The second part has a portion which is transversal with respect to the longitudinal direction of the whole strip, and a portion in the longitudinal direction of the whole strip. The second conductive strip 340 according to the invention is connected to signal ground GND at a second ground point G2, which, like the first ground point G1, is relatively near the antenna feed point F. The second ground point G2 is at the end of the second conductive strip, and the second conductive strip extends therefrom, away from the radiating element and the feed conductor thereof. The second conductive element 340 is thus intended only for shaping the directivity pattern in the receiving band. Using two strips, the directivity pattern in the receiving band can be shaped even more round than when using one strip. Moreover, the second conductive strip enhances the independence of the tuning of the directivity patterns in the transmitting and receiving bands.

Figure 4:
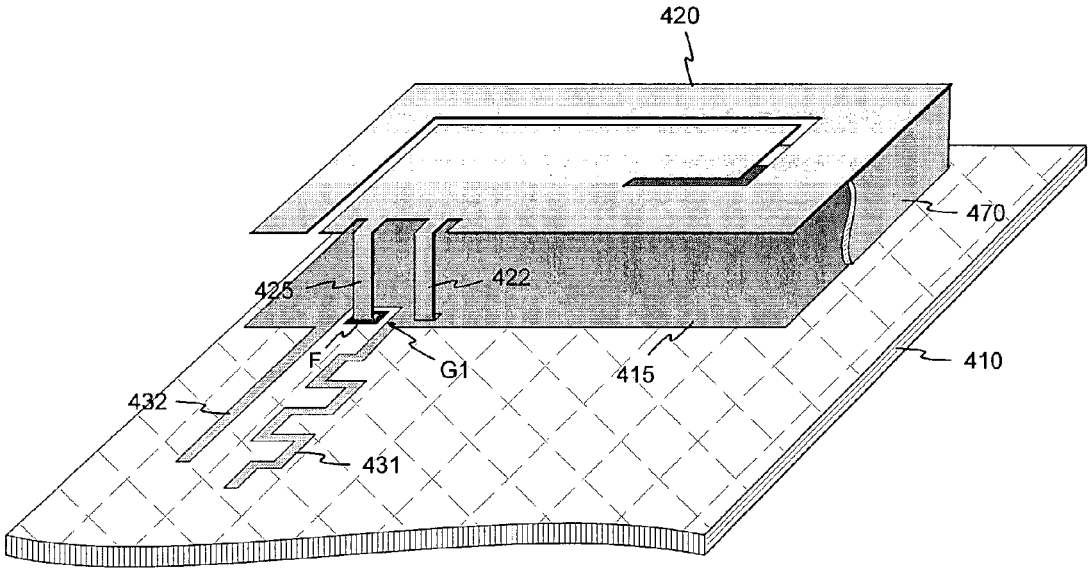
FIG. 4 is a third example illustrating how the directivity pattern of an antenna can be changed in accordance with the invention.

FIG. 4 shows a third example of an antenna structure according to the invention. The radiating element proper 420 is now a conductive plane elevated from the radio telephone circuit board 410. The circuit board 410 has a ground plane 415 below the radiating plane 420, which is a part of the signal ground. The radiating plane and ground plane are interconnected at a point through a short-circuit conductor 422, which means the antenna in question is a planar inverted-F antenna (PIFA). A feed conductor 425 of the spring contact type extends out from the edge of the radiating plane and is galvanically connected to an antenna feed point F on the circuit board 410. In this example the latter is quadrangular and surrounded by the ground plane 415 from three sides. Next to the feed point F, at point G1, a first conductive element 431 according to the invention is connected to the ground plane. In this example the first conductive element is a meander-type conductive strip on the surface of the circuit board 410 and it is directed perpendicularly away from the PIFA, as observed from the ground plane connecting point G1. On the other side of the feed point F, a second conductive element 432 according to the invention is connected to the ground plane. This is a straight conductive strip on the surface of the circuit board 410, directed perpendicularly away from the PIFA, as observed from the ground plane connecting point.

In the example of FIG. 4 the radiating plane 420 is divided by the slot in the plane into two branches so that the PIFA has two operating frequency bands. The conductive elements according to the invention can be used to affect the directivity characteristics of the antenna in either one of the bands. FIG. 4 also shows a portion of the dielectric support frame 470 for the radiating plane.

Figure 5:
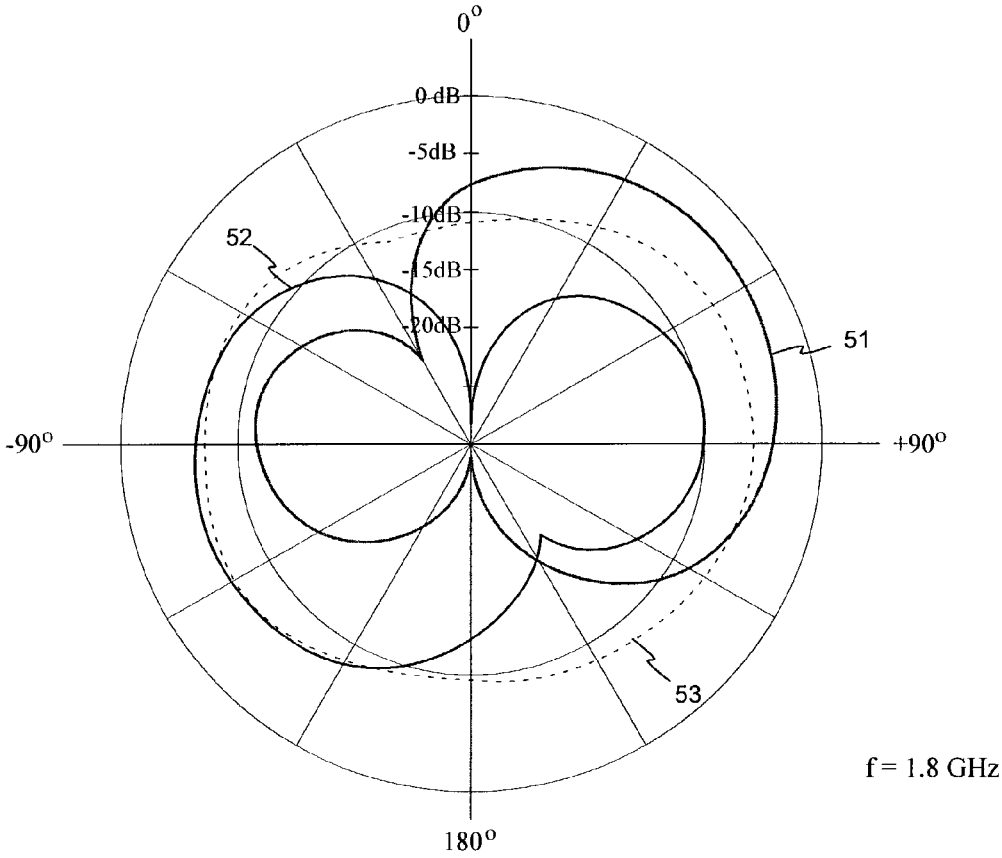
FIG. 5 is an example of the effect of the invention on the directivity characteristics of an antenna.

FIG. 5 shows an example illustrating the directivity characteristics of an antenna structure like the one depicted in FIG. 3, placed in a mobile phone. The antenna is dimensioned so as to have two bands for systems GSM900 and GSM1800 (Global System for Mobile telecommunications). The transmitting band of the latter for a mobile station is 1710 to 1785 MHz, and receiving band 1805 to 1880 MHz. FIG. 5 shows the antenna gain on the horizontal plane when the mobile phone is oriented in an upright position. Direction 0° refers to the direction outwards of the front side of the phone, i.e. in the normal use position, towards the user's head. Curve 51 shows antenna gain alteration prior to making additions according to the invention in the structure. The phone structure in question happens to produce distinct gain notches in directions 30° and 180°. In direction 0°, radiation is relatively strong. This result applies approximately in the whole upper operating band of the antenna, i.e. from 1710 to 1880 MHz.

The conductive strips according to the invention are dimensioned so as to shape directivity characteristics in the frequency band of the GSM1800 system. Curve 52 shows the gain alteration of such an antenna structure at transmitting band frequencies. The notch in the gain is now arranged to be in direction 0°, which substantially reduces radiation directed towards the user's head. Curve 53 shows gain variation at receiving band frequencies. There are no gain notches at all that would indicate large attenuation, so the antenna receives relatively well from all directions.

Figure 6:
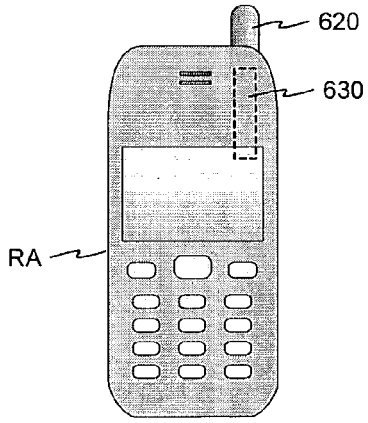
FIG. 6 is an example of a radio telephone having an antenna according to the invention.

FIG. 6 shows a radio telephone RA with an antenna structure according to the invention. The antenna structure comprises an external radiating element 620 placed within a protective sheath, and at least one conductive element 630 within the case of the radio telephone, which conductive element affects the directivity pattern of the antenna.

Antenna structures according to the invention were described above. The invention does not limit the shapes of antenna elements, nor the shapes of the additional conductive elements, to those described above. The conductive elements affecting the directivity pattern may also be conductive wires, for example, and they may be located, say, on the inner surface of the case of the radio apparatus. Nor does the invention limit the manufacturing method of the antenna or the materials used therein. The inventional idea can be applied in different ways within the scope defined by the independent claim 1.

What is claimed is:

1. An antenna of a radio apparatus with a directional pattern that can be shaped comprising:

a radiating element;

a feed conductor of the radiating element connected to the radio apparatus at a feed point; and at least one conductive element internal to the radio apparatus and connected only to signal ground at a ground point located relatively close to said feed point;

wherein the directional pattern of the antenna is shaped by the conductive element.

2. The antenna according to claim 1, wherein the conductive element comprises a part pointing from the ground point in a direction substantially opposite to a feeding direction of the radiating element for equalizing the antenna directional pattern at receiving band frequencies of the radio apparatus.

3. The antenna according to claim 2, wherein the length of said part of the conductive element is substantially a quarter of the wavelength of an operating frequency of the antenna.

4. The antenna according to claim 1, wherein the conductive element comprises a part pointing from the ground point substantially in a feeding direction of the radiating element for changing a direction angle of a directional pattern notch at transmitting band frequencies of the radio apparatus.

5. The antenna according to claim 4, wherein said direction angle corresponds to a position of the head of a user of the radio apparatus in a normal use position of the radio apparatus.

6. The antenna according to claim 1, wherein said at least one conductive element is in the form of conductive strips belonging to a circuit board internal to the radio apparatus.

7. The antenna according to claim 1, wherein said at least one conductive element is in the form of conductive strips on an inner surface of casing of the radio apparatus.

8. The antenna according to claim 1, the radiating element is a helix conductor.

9. The antenna according to claim 1, wherein the radiating element is a planar element and the antenna further comprises a ground plane such that the antenna is a planar inverted F-antenna.

10. A radio apparatus comprising an antenna having a radiating element and a feed conductor thereof connected to the radio apparatus at a feed point, the radio apparatus further comprising, at least one internal conductive element, for shaping the directional pattern of the antenna, said conductive element being connected only to signal ground at a ground point located relatively close to said feed point.

* * * * *